US012297634B2

(12) United States Patent
Cimarosti

(10) Patent No.: US 12,297,634 B2
(45) Date of Patent: May 13, 2025

(54) ADJUSTABLE TOILET FLAPPER VALVE ASSEMBLY

(71) Applicant: Dominic Cimarosti, Sheboygan, WI (US)

(72) Inventor: Dominic Cimarosti, Sheboygan, WI (US)

(73) Assignee: Lavelle Industries, Inc., Burlington, WI (US)

( * ) Notice: Subject to any disclaimer, the term of this patent is extended or adjusted under 35 U.S.C. 154(b) by 933 days.

(21) Appl. No.: 17/147,792

(22) Filed: Jan. 13, 2021

(65) Prior Publication Data

US 2021/0246642 A1 Aug. 12, 2021

Related U.S. Application Data

(60) Provisional application No. 62/971,727, filed on Feb. 7, 2020.

(51) Int. Cl.
*E03D 1/35* (2006.01)

(52) U.S. Cl.
CPC ..... *E03D 1/35* (2013.01)

(58) Field of Classification Search
CPC ..... E03D 1/35
USPC ..... 4/393
See application file for complete search history.

(56) References Cited

U.S. PATENT DOCUMENTS 3,360,803 A 1/1968 Gross
3,368,224 A 2/1968 Ament
3,397,409 A 8/1968 Schlank
3,792,588 A 2/1974 Gilaad
4,189,795 A 2/1980 Conti
4,419,773 A 12/1983 Sullivan
4,497,076 A * 2/1985 Sullivan ..... E03D 1/142 4/395
4,655,397 A 4/1987 Gorney
4,841,579 A 6/1989 Antunez
5,090,066 A 2/1992 Schoepe
5,195,189 A 3/1993 Gibb
5,330,107 A 7/1994 Karathanos
5,390,375 A 2/1995 Fenstrum, Jr.
5,421,361 A 6/1995 Johnson
5,603,128 A 2/1997 Nichols-Roy
5,623,961 A 4/1997 Nichols-Roy
5,692,249 A 12/1997 Johnson
5,715,859 A 2/1998 Nichols-Roy
5,836,346 A 11/1998 Nichols-Roy
5,903,931 A 5/1999 Kolb, Sr.
5,964,247 A 10/1999 Johnson
5,966,749 A * 10/1999 Goesling ..... E03D 1/34 4/395
5,975,125 A 11/1999 Nichols-Roy
6,003,541 A 12/1999 Nichols-Roy
6,142,174 A 11/2000 Nichols-Roy
6,155,288 A 12/2000 Johnson
(Continued)

*Primary Examiner* — David P Angwin
*Assistant Examiner* — William R Klotz
(74) *Attorney, Agent, or Firm* — Reinhart Boerner Van Deuren P.C.

(57) ABSTRACT

A toilet flapper valve assembly is provided. The flapper valve assembly has a flapper, cone and an adjustment dial. The adjustment dial controls the flow of water into and flow of air out of the cone. Adjustment of the adjustment dial relative to the cone simultaneously adjusts the flow of water into and air out of the cone.

18 Claims, 12 Drawing Sheets

(56) References Cited

U.S. PATENT DOCUMENTS

| | | | | |
|---|---|---|---|---|
| 6,173,457 | B1 | 1/2001 | Higgins | |
| 6,192,526 | B1 | 2/2001 | Nichols-Roy et al. | |
| 6,260,574 | B1 | 7/2001 | Nichols-Roy | |
| 6,381,765 | B1 | 5/2002 | Liu | |
| 6,401,268 | B2 | 6/2002 | Higgins | |
| 6,651,265 | B2 | 11/2003 | Kwen | |
| 6,880,181 | B2 | 4/2005 | Nichols-Roy et al. | |
| 6,913,035 | B2 | 7/2005 | Huang | |
| 7,222,375 | B2 | 5/2007 | Chen | |
| 7,636,958 | B2 | 12/2009 | Nichols-Roy et al. | |
| 8,196,898 | B1 | 6/2012 | Huang | |
| 8,365,320 | B1 * | 2/2013 | Lordahl | E03D 1/34 4/417 |
| 8,387,652 | B2 | 3/2013 | Guthrie | |
| 8,590,066 | B2 | 11/2013 | Torres et al. | |
| 9,062,795 | B2 | 6/2015 | Guthrie | |
| 9,121,162 | B1 | 9/2015 | Guthrie | |
| 9,791,049 | B2 | 10/2017 | Guthrie et al. | |
| 10,190,300 | B2 | 1/2019 | Guthrie | |
| 10,859,165 | B2 | 12/2020 | Guthrie | |
| 11,286,655 | B2 * | 3/2022 | Smith | E03D 1/35 |
| 2003/0079780 | A1 | 5/2003 | Aguilo | |
| 2004/0172747 | A1 | 9/2004 | Sirizzotti | |
| 2005/0172387 | A1 | 8/2005 | Higgins | |
| 2005/0283896 | A1 | 12/2005 | Huang | |
| 2008/0078454 | A1 | 4/2008 | Nichols-Roy et al. | |
| 2008/0134422 | A1 | 6/2008 | Nichols-Roy et al. | |
| 2008/0244818 | A1 | 10/2008 | Li | |
| 2008/0271233 | A1 | 11/2008 | Han | |
| 2009/0014488 | A1 | 6/2009 | Han | |
| 2009/0144888 | A1 * | 6/2009 | Han | E03D 1/306 251/298 |
| 2014/0059796 | A1 | 3/2014 | Guthrie | |
| 2014/0325749 | A1 * | 11/2014 | Huang | E03D 1/306 4/393 |
| 2016/0010317 | A1 * | 1/2016 | Guthrie | F16K 1/20 4/393 |
| 2016/0032577 | A1 | 2/2016 | Guthrie | |
| 2020/0325669 | A1 | 10/2020 | Guthrie | |
| 2023/0160191 | A1 * | 5/2023 | Le | E03D 1/35 4/393 |

* cited by examiner

ADJUSTABLE TOILET FLAPPER VALVE ASSEMBLY

This patent application claims the benefit of U.S. Provisional Patent Application No. 62/971,727, filed Feb. 7, 2020, the entire teachings and disclosure of which are incorporated herein by reference thereto.

FIELD OF THE INVENTION

The present invention relates generally to indoor plumbing and gravity-operated flush toilets. More particularly, the present invention relates to flapper valves that are used in such toilets and to a flapper valve and assembly of the type that has a ballast built into it that is adjustable to adjust to the flow of water into the ballast and to the flow of air from the ballast.

BACKGROUND OF THE INVENTION

Conventional gravity-operated flush toilets have several basic components. The porcelain or china components include a bowl and a water tank mounted on top of a rear portion of the bowl. The bowl and tank can be separate pieces bolted together to form a two-piece toilet. Other gravity-operated flush toilets are made as a one-piece toilet in which the bowl and tank are made as one continuous integral piece of china.

More importantly, the plumbing components of a gravity-operated flush toilet include a fill valve in the tank which is connected to a water supply line, a drain hole in the bottom of the tank that communicates with the bowl, and a flapper valve that normally closes and seals the drain hole.

Toilet flapper valves are typically formed as a single structure having a rim for sealing the drain hole with the flapper valve rim following flushing. The flapper valve is often formed of a soft elastomeric material and is hinged to allow the valve to be pivotally moved upwardly and away from the drain hole by means of a chain that is connected to the flush handle on the outside of the tank. Once the tank sufficiently empties, the flapper valve then returns to a position where it seals the drain hole.

Such toilet flapper valves are also typically formed to include a ballast structure which is a dome-like or cone-shaped structure that controls the buoyancy of the flapper valve. The buoyancy of a flapper valve is an important function because it determines how much or how little water is emptied from the tank upon flushing, thus creating water conservancy issues. The buoyancy of the flapper valve is determined by how quickly air is allowed to escape from the ballast.

Therefore, one way that the buoyancy of the flapper valve ballast can be controlled is by controlling the rate at which air within the ballast can flow out of the ballast. This can be done by creating and/or adjusting the size of an aperture at a point within the flapper valve ballast. Another way that the buoyancy of the flapper valve ballast can be controlled is by controlling the rate at which water can flow back into the ballast.

BRIEF SUMMARY OF THE INVENTION

Embodiments of the application provide new and improved flapper valve assemblies that provide improvements over the current state of the art.

In an embodiment, a toilet flapper valve assembly including a flapper, a cone and an adjustment dial is provided. The cone is mounted to the flapper. The cone and flapper define a cavity. The cone has a first port and a second port. The first and second ports fluidly communicate the cavity with an exterior of the cone. The adjustment dial rotatably mounts relative to the flapper for rotation about an axis of rotation. The adjustment dial has a first flow adjustment region that cooperates with the first port for regulating flow therethrough. The adjustment dial has a second flow adjustment region that cooperates with the second port for regulating flow therethrough. The first and second flow adjustment regions are fixed to one another such that rotation of the adjustment dial about the axis of rotation simultaneously rotates both the first and second flow adjustment regions about the axis of rotation relative to the first and second ports. The first flow adjustment region includes a first flow region that that extends angularly about the axis of rotation. The first flow region has a first portion that increases in dimension when moving angularly in a first direction about the axis of rotation to vary a degree of exposure of the first port to fluid communication with the exterior of the cone. The second flow adjustment region includes at least one flow aperture and at least one imperforate region adjacent the flow aperture.

In one embodiment, in a first angular position of the adjustment dial relative to the cone, a first section of the first flow region aligns with the first port while the at least one flow aperture aligns with the second port. In a second angular position of the adjustment dial relative to the cone, a second section of the first flow region aligns with the first port while the imperforate region aligns with and covers the second port.

In one embodiment, the first and second sections of the first flow region have the same size and expose the same amount of the first port to fluid communication with the exterior of the cone.

In one embodiment, the first flow region is formed by a plurality of spaced apart apertures extending through the adjustment dial and angularly about the axis of rotation. The first portion of the first flow region that increases in dimension when moving angularly in the first direction about the axis of rotation is provided by a plurality of apertures that have increase in diameters when moving angularly in the first direction about the axis of rotation.

In one embodiment, the plurality of apertures includes at least a first aperture and a second aperture that have a same diameter. The first aperture re part of the first section of the first flow region. The second aperture are part of the second section of the first flow region.

In one embodiment, the first flow region is formed by a plurality of spaced apart apertures extending through the adjustment dial and angularly about the axis of rotation. The plurality of apertures includes at least a first aperture and a second aperture that have a same diameter. The first aperture is part of the first section of the first flow region. The second aperture is part of the second section of the first flow region.

In one embodiment, the adjustment dial is snap attached to the cone.

In one embodiment, the cone includes a radially extending annular flange. The flapper includes an opening bounded by a flange portion. The cone extends axially through the opening with the annular flange of the cone positioned on a first side of the flange portion of the flapper. The adjustment dial includes an end region that is positioned on a second side of the flange portion of the flapper capturing the flange portion of the flange portion of the flapper axially therebetween in a sandwiched arrangement axially securing the cone and adjustment dial to the flapper.

In one embodiment, the adjustment dial is snap attached to the cone axially securing the adjustment dial to the cone.

In one embodiment, the radially extending flange of the cone is proximate the second port. The snap attachment between the adjustment dial and the cone is proximate the first port.

In one embodiment, the snap attachment between the cone and the adjustment dial maintains the end region of the adjustment dial in axial location relative to the annular flange of the cone and the flange portion of the flapper.

In one embodiment, a hinge component is attached to the flapper defining a hinge axis that is generally perpendicular to the axis of rotation. The first port is axially offset from the hinge axis a first distance along an offset axis that is perpendicular to the hinge axis and the axis of rotation. The second port is axially offset from the hinge axis a second distance along the offset axis.

In one embodiment, the cone extends outward from the flapper to a free end of the cone. The first port being positioned proximate the free end and the second port being positioned proximate the flapper.

In one embodiment, the second distance is greater than the first distance.

In one embodiment, the plurality of apertures that form the first flow region are formed in a distal end of the adjustment dial. The at least one flow aperture of the second flow adjustment region is formed in an annular side of the adjustment dial. Flow through the plurality of apertures that form the first flow region is substantially perpendicular to the flow through the at least one flow aperture of the second flow adjustment region.

In one embodiment, the plurality of spaced apart apertures forming the first flow region includes a third aperture angularly spaced from the first and second apertures. The third aperture has a diameter that is greater than the diameter of the first and second apertures.

In one embodiment, the cone is mounted to the flapper in a fixed angular position relative to the axis of rotation such that the first and second ports remain in a fixed orientation relative to the flapper regardless of the position of the adjustment dial.

In an embodiment, a method of adjusting the buoyancy of a toilet flapper valve assembly according to any preceding embodiment is provided. The method includes rotating the adjustment dial about the axis of rotation relative to the cone to simultaneously adjust which portion of the first flow adjustment region aligns with the first port and which portion of the second flow adjustment region aligns with the second port.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
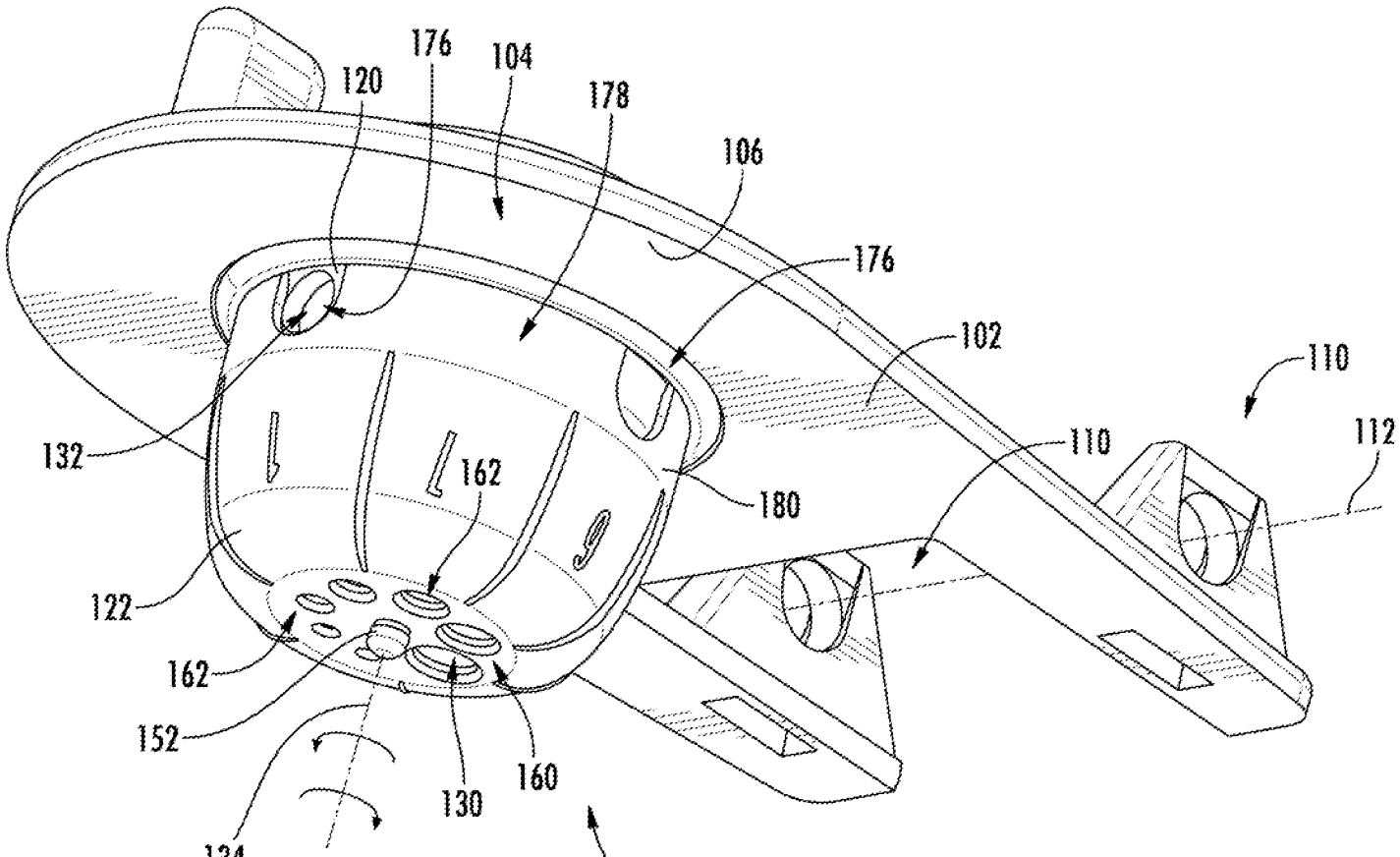
FIG. 1 is a perspective illustration of a flapper valve assembly according to the application.
Figure 2:
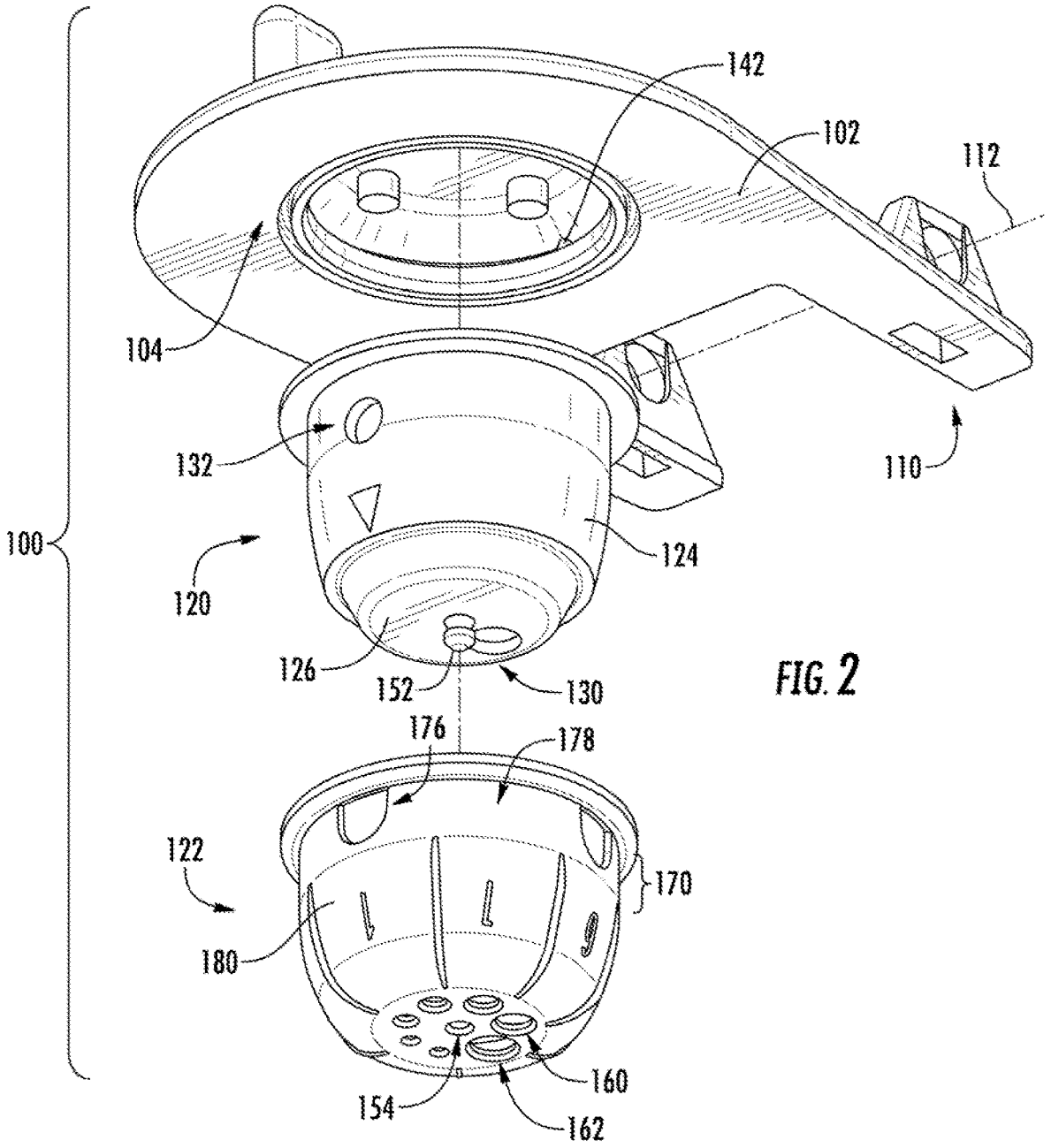
FIG. 2 is an exploded illustration of the flapper valve assembly of FIG. 1.
Figure 3:
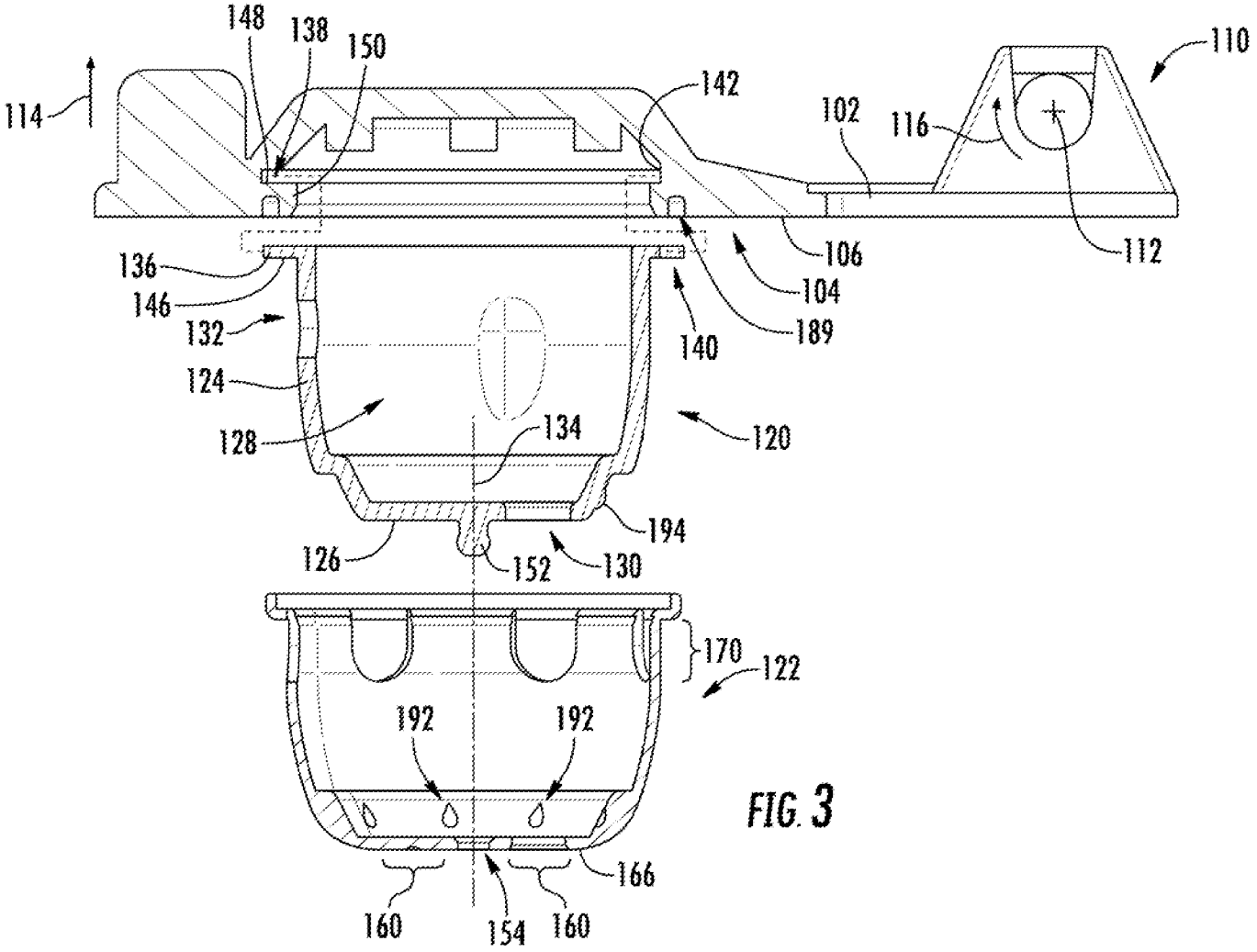
FIG. 3 is an exploded and cross-sectional illustration of the flapper valve assembly of FIG. 1.

FIGS. 1-3 illustrate a toilet flapper valve assembly 100 (also referred to herein as "flapper assembly 100") for use in regulating the volume of water used when flushing a toilet and/or the volume of water that is dispensed into a toilet tank subsequent to a user flushing the toilet. The buoyancy of the toilet flapper valve assembly 100 can be adjusted to change the amount of water that is used during each flush.

The flapper valve assembly 100 includes a flapper 102. A seal region 104 of the flapper 102 cooperates with the drain hole of the tank (not shown) to selectively allow water to drain from the tank. In this embodiment, the seal region 104 is provided directly by an underside 106 of the flapper 102. In other embodiments, the seal region 104 could be provided by a separate seal member that is attached to the body of the flapper 102. As such, the flapper 102 could be formed from a soft compliant material when it is directly used to form a seal or could be a more rigid material if a separate seal member is attached to the body of the flapper 102.

In a preferred embodiment where the flapper body forms the seal, the flapper 102 is formed from a real or synthetic rubber having a suitable durometer or softness to provide a sufficient seal. In a preferred embodiment, the flapper 102 is comprised of a real rubber material that is resistant to chemicals.

A hinge component 110 is provided that is used to operably attach the flapper 102 to the rest of the toilet for rotation about hinge axis 112. More particularly, when a user flushes the toilet, a chain (not shown) connected to the flapper 102 provides a force illustrated by arrow 114 that causes the flapper 102 to rotate about hinge axis 112 represented by arrow 116. This rotation of the flapper 102 causes the seal region 104 to become unseated from the pipe forming the drain hole of the tank allowing water within the tank to drain therefrom and flush the toilet.

With the flapper 102 unseated and located within the water in the tank, the time it takes for the buoyancy of the flapper 102 drop sufficiently low that the flapper will reseat itself determines the amount of water that is dispensed from the tank, assuming that all of the water is not dispensed.

The flapper assembly 100 includes a cup shaped cone 120 (also referred to as "cone 120") that provides a base level of buoyancy to the flapper assembly 100 and an adjustment dial 122 that cooperates with cone 120 to adjust the buoyancy.

Cone 120 has a sidewall 124 and bottom wall 126 that define a cone cavity 128. The flow of water into cone cavity 128 and the flow of air out of cone cavity 128 determines the buoyancy of the flapper assembly 100.

Cone 120 includes a first port 130 through which water within the toilet tank flows into the cone cavity 128. First port 130 is formed in the bottom wall 126 and is radially offset from an axis of rotation 134. In this embodiment, the bottom wall 126 forms a free end of the cone 120. In alternative embodiments, the first port 130 could be formed in sidewall 124, but preferably proximate the free end of the cone, e.g. spaced away from flapper 102.

Cone 120 includes a second port 132 through which air exits the cone cavity 128 as water flows into the cone cavity 128 through first port 130. Second port 132 is formed through sidewall 124.

In this embodiment, flow through the first port 130 is generally perpendicular to the flow through second port 132 (e.g. plus or minus 15 degrees).

Cone 120 includes radially extending annular flange 136 that is received by annular groove 138 formed in flapper 102 to, at least in part, axially secure the cone 120 to the flapper 102.

Figure 15:
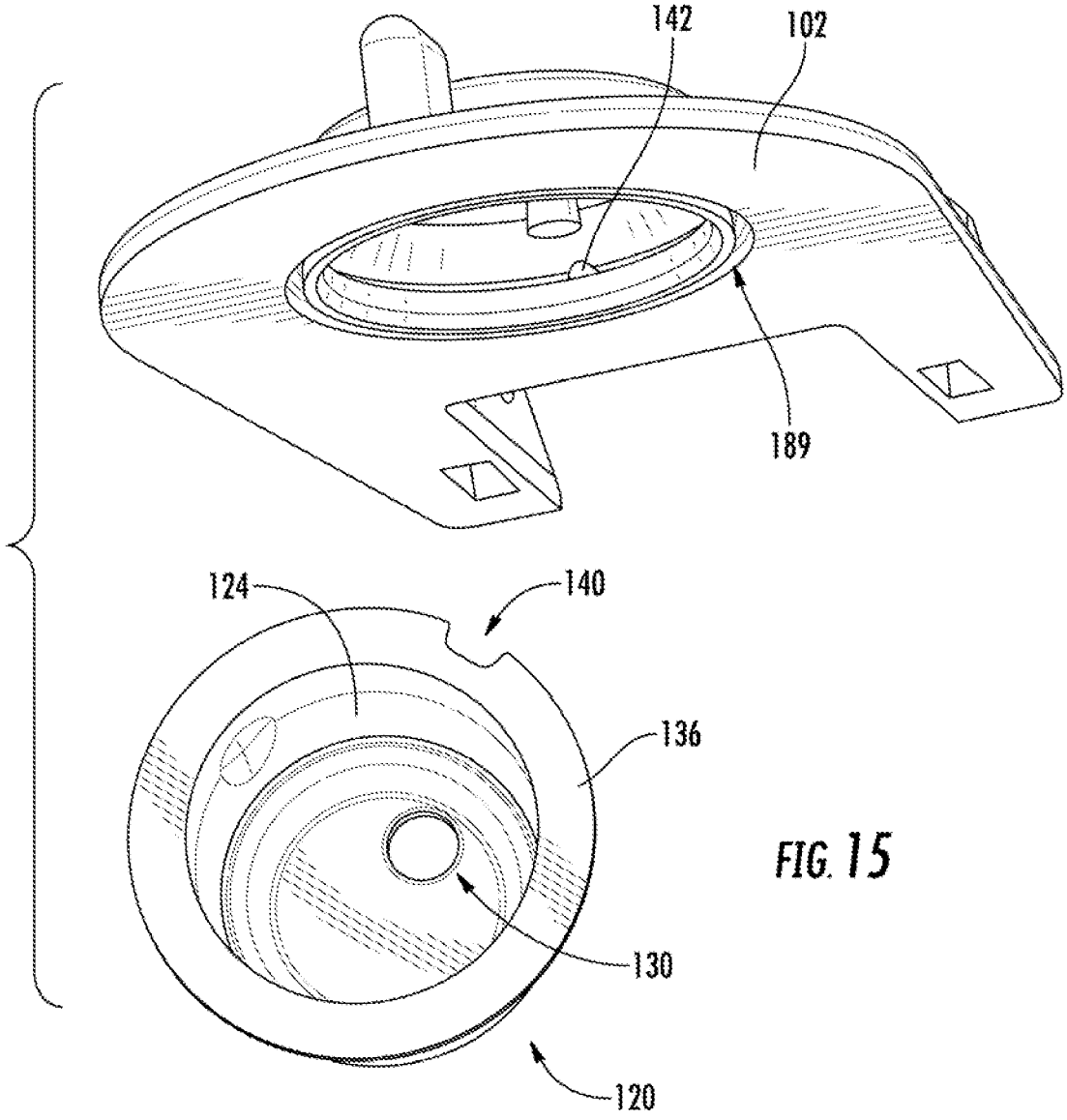
FIG. 15 is a perspective illustration illustrating the flapper and cone of the flapper valve assembly of FIG. 1.
Figure 16:
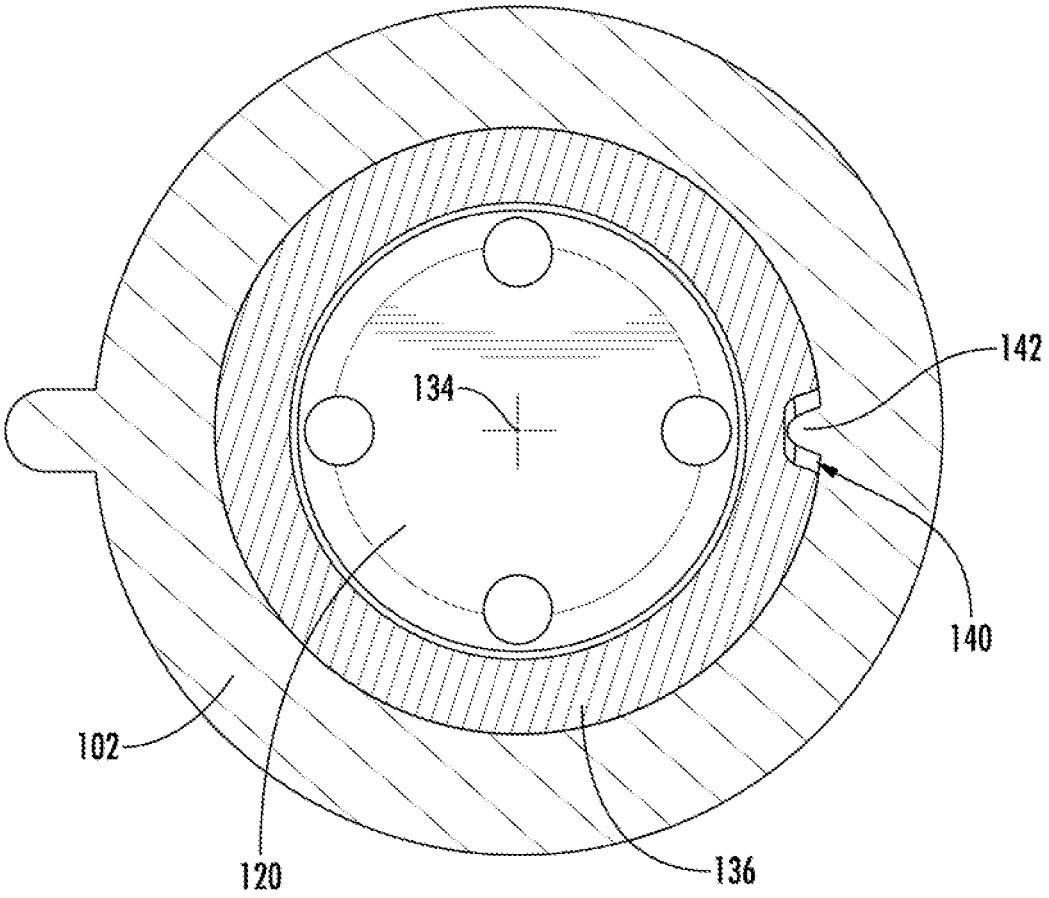
FIG. 16 is a cross-sectional illustration of the flapper and cone of the flapper valve assembly of FIG. 1.

With additional reference to FIGS. 15 and 16, the annular flange 136 includes at least one radially directed notch 140 that engages a radially inward extending nib 142 that extends into the annular groove 138. This engagement substantially prevents (e.g. plus or minus 10 degrees) angular rotation of the cone 120 relative to flapper 102, e.g. about axis 134. This maintains the positions of the first and second ports relative to hinge axis 112 as well as each other.

Flange 136 has an under side 146 that abuts surface 148 of radially inward extending flange portion 150 when cone 120 is attached to flapper 102. This axial abutment mounts the cone 120 to the flapper 102. Flange portion 150 defines an opening through which the sidewall of cone 120 extends when in a mounted state.

Adjustment dial 122 is used to selectively adjust how much of ports 130, 132 are exposed to the exterior of cone 120, e.g. to adjust the flow area through which fluid can flow into and out of cone 120.

Figure 4:
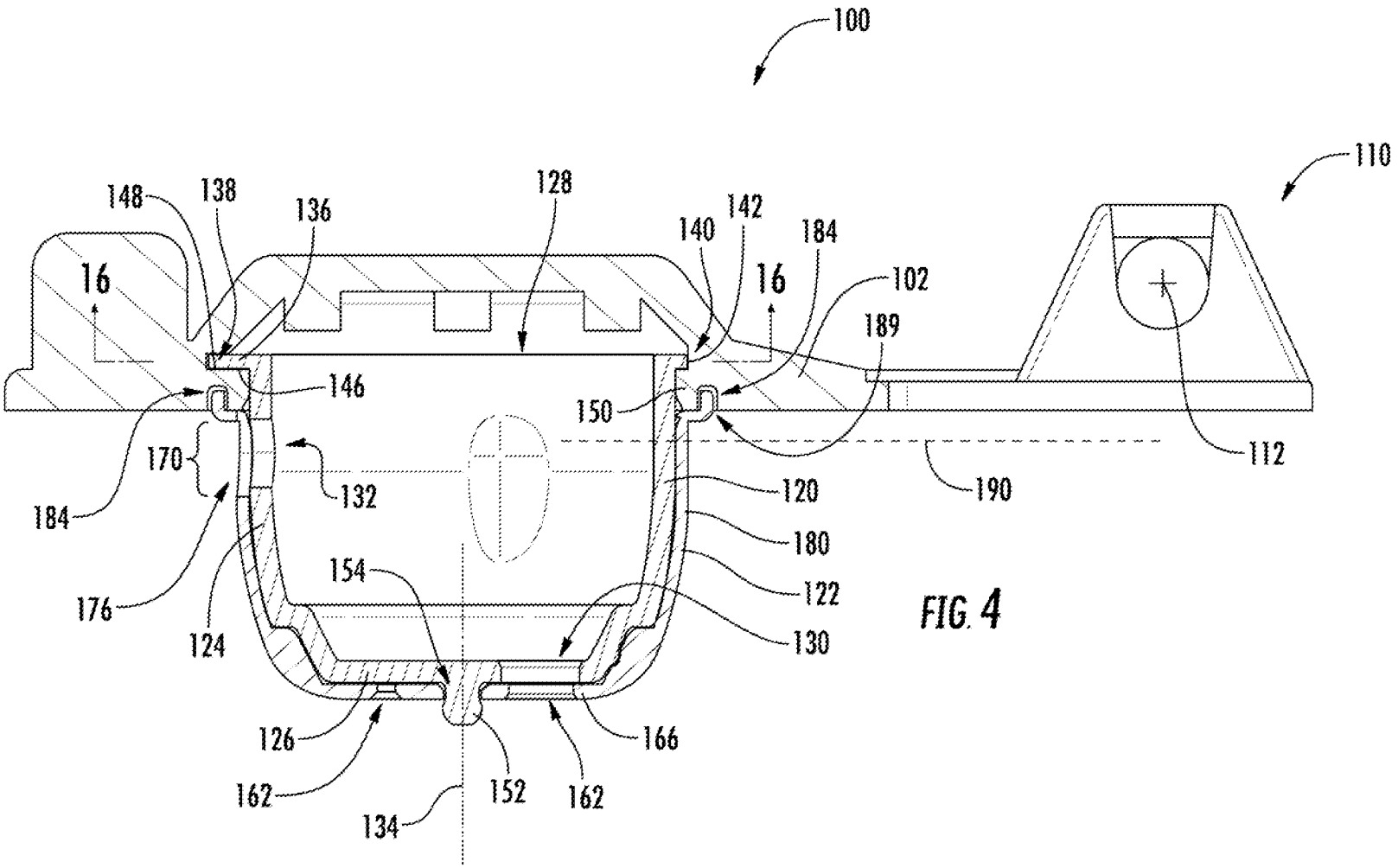
FIG. 4 a cross-sectional illustration of the flapper valve assembly of FIG. 1.

Adjustment dial 122 snap attaches to the cone 120 (see e.g. FIG. 4). In this embodiment, cone 120 includes an attachment pin 152 that snap engages adjustment dial 122 by passing through aperture 154 formed in adjustment dial 122 to rotatably secure adjustment dial 122 to the cone 120. Attachment pin 152 has an enlarged head that secures the adjustment dial 122 to the cone 120.

Adjustment dial 122 rotates relative to cone 120 about axis 134.

Figure 5:
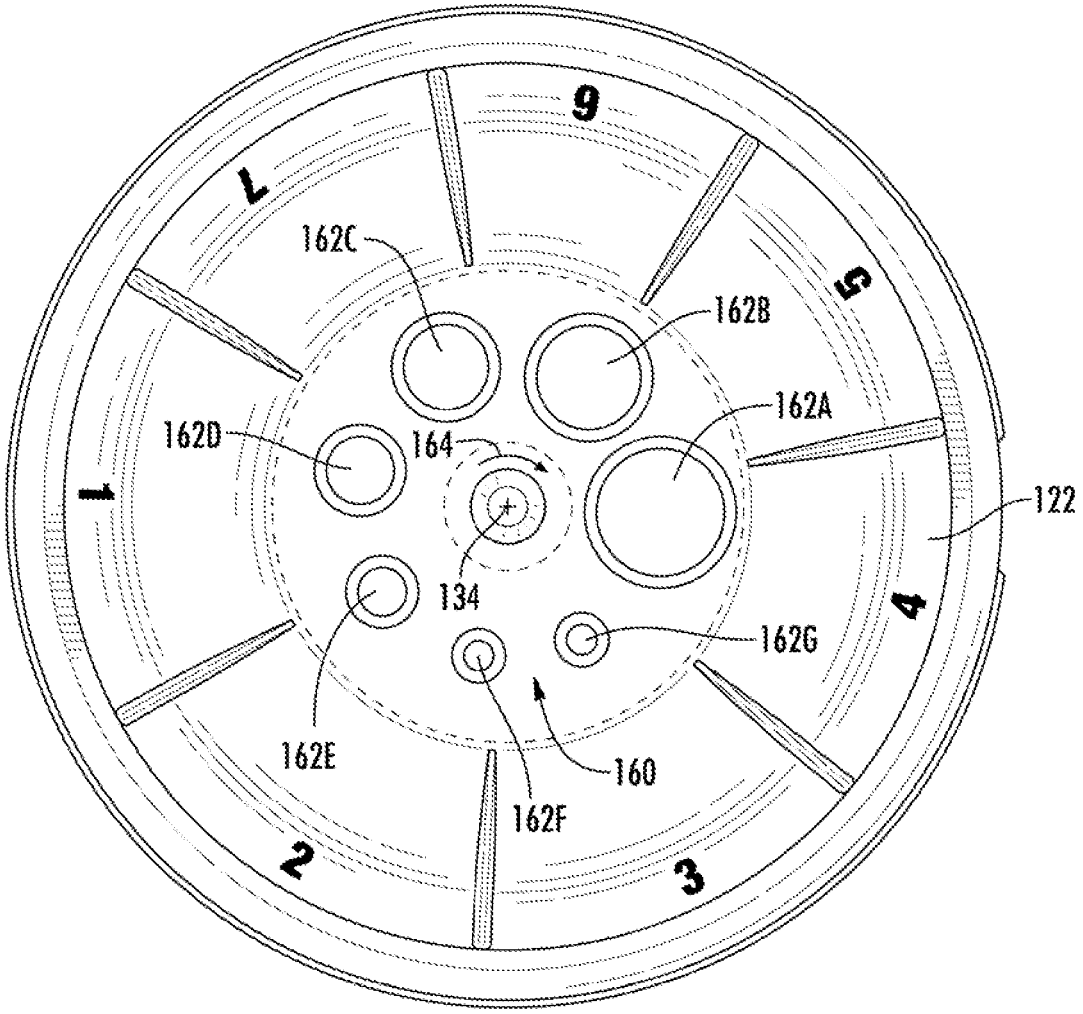
FIG. 5 is an end view illustration of the adjustment dial of the flapper valve assembly of FIG. 1.

To adjust the flow through first port 130, adjustment dial 122 includes a first flow adjustment region 160 (illustrated between dashed lines in FIG. 5) that cooperates with the first port 130 of the cone 120 for regulating flow through first 130. The first flow adjustment region 160 extends angularly about and is radially offset from axis of rotation 134.

The first flow adjustment region 160 includes a flow region that extends angularly about the axis of rotation 134. The flow region is the portion of the first flow adjustment region 160 that extends through the adjustment dial 122. In this embodiment, the flow region is provided by a plurality of angularly spaced apart apertures 162 (162A-1620). Each aperture 162 can be viewed as a different section of the flow region of the first flow adjustment region 160.

The flow region has a portion that increases in dimension when moving angularly about the axis of rotation 134 in a first direction, illustrated by arrow 164. In this embodiment, this portion of the flow region is provided by apertures 162A through 162F. Here the dimension increases when moving angularly in the direction of arrow 164 due to the increase in diameter of the apertures when moving in reverse order from aperture 162F to aperture 162A in a clockwise direction in FIG. 5.

The increasing diameter of apertures 162A-162F varies the degree of exposure of the first port 130 to the exterior of cone 120 depending on which aperture 162A-162F is aligned with (e.g. overlapped with) first port 130. In other words, the larger the diameter of the aperture 162 that is aligned with port 130, the easier it is for fluid to flow through port 130, thus reducing the buoyancy of the valve assembly 100.

It is noted that the flow region of this embodiment has a second portion where the dimension does not increase when moving angularly about axis of rotation 134. In particular, the diameter of apertures 162F and 162G are the same.

Apertures 162 are formed in an end wall 166 of adjustment dial 122. The end wall 166 is substantially planar as well as coplanar with bottom wall 126 of cone 120.

Figure 6:
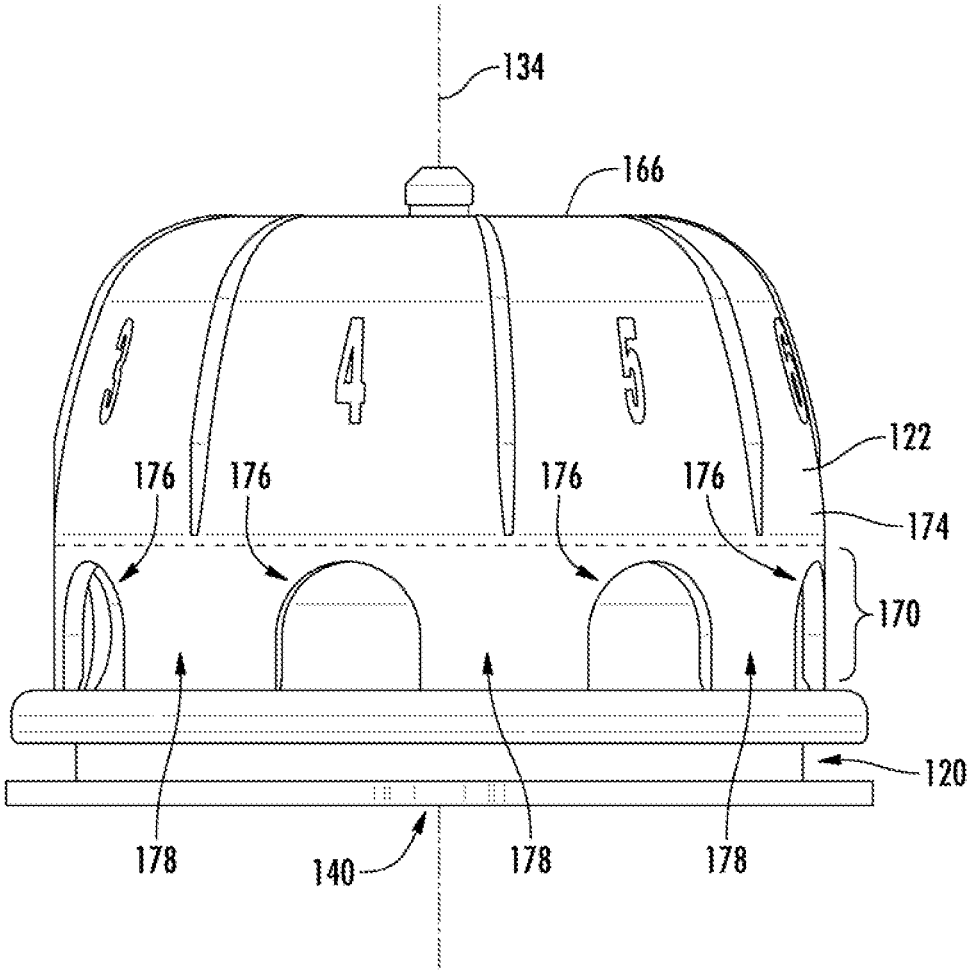
FIGS. 6 and 7 are side view illustrations of the adjustment dial of the flapper valve assembly of FIG. 1.

To adjust the flow through second port 132, adjustment dial 122 includes a second flow adjustment region 170 (the axial region of sidewall 174 of adjustment dial 122 delineated by bracket 170 and a dashed line in FIG. 6) that cooperates with (e.g. overlaps with) the second port 132.

The second flow adjustment region 170 includes a plurality of flow apertures 176 that are angularly spaced apart and separated by a plurality of imperforate regions 178. The array of apertures 176 and imperforate regions 178 extends angularly about axis of rotation 134. The apertures 176 are formed through side wall 180 of adjustment dial 122.

The exposure of the second port 132 to the exterior of cone 120 is adjusted depending on which portion of the flow adjustment region 170 overlaps with second port 132.

Figure 7:
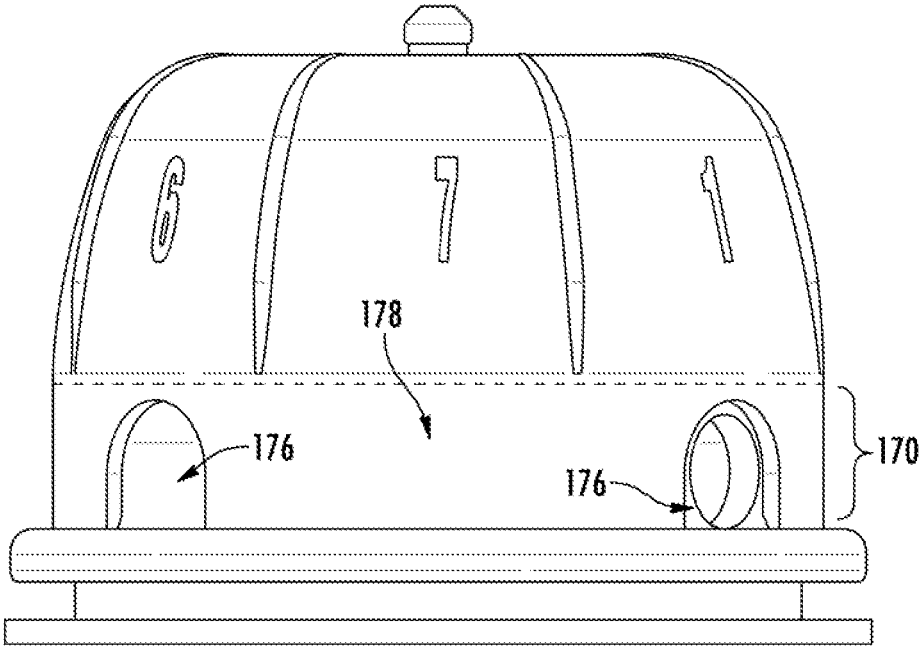
Figure 10:
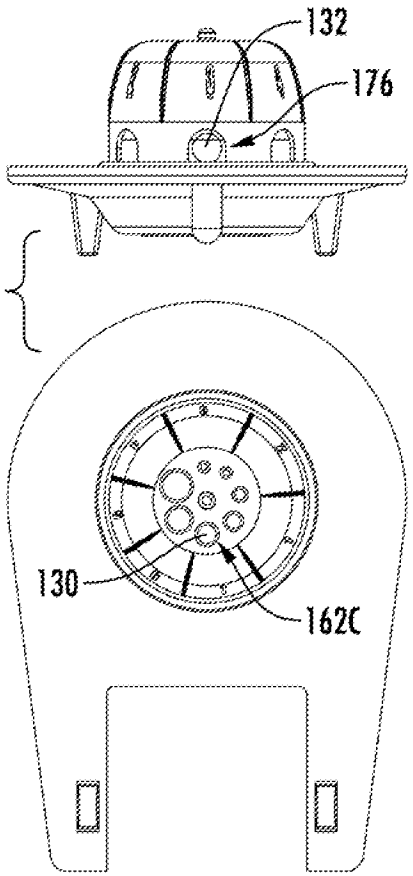
FIGS. 8-14 are alternative orientations of the adjustment dial relative to the flapper and/or cone of the flapper valve assembly of FIG. 1 that provide different buoyancy characteristics for the flapper valve assembly.
Figure 9:
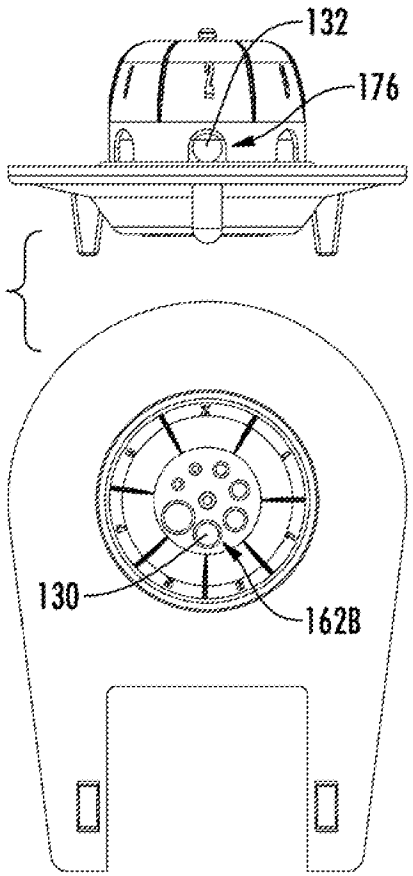

It is noted that in this embodiment, an enlarged imperforate region 178 is provided between one set of adjacent apertures 176. This imperforate region 178 is illustrated in FIG. 7.

It is a feature of the present embodiment that the first and second flow adjustment regions 160, 170 are fixed to one another such that rotation of the adjustment dial 122 about axis of rotation 134 simultaneously rotates both the first and second flow adjustment regions 160, 170 about the axis of rotation 134 relative to the first and second ports 130, 132.

The present embodiment has a plurality of different buoyancy configuration depending on the angular orientation of the adjustment dial 122 relative to cone 120.

Figure 8:
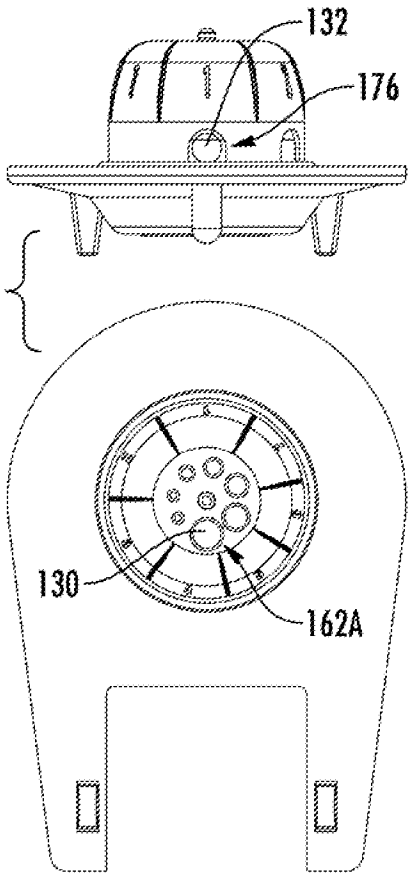
Figure 11:
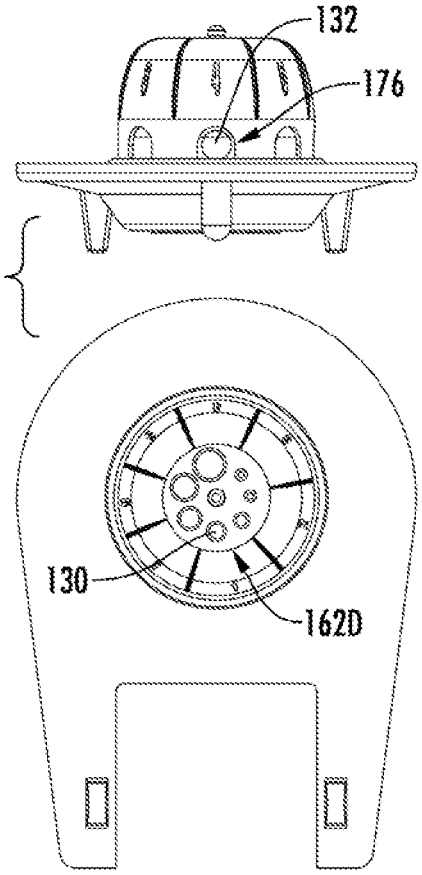
Figure 12:
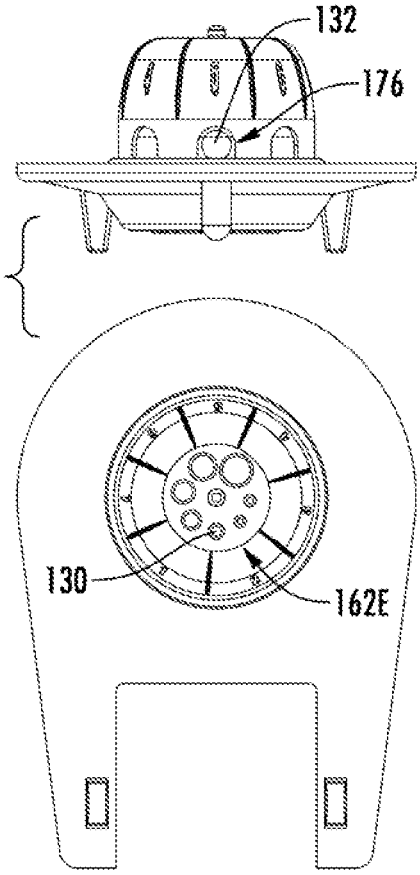
Figure 13:
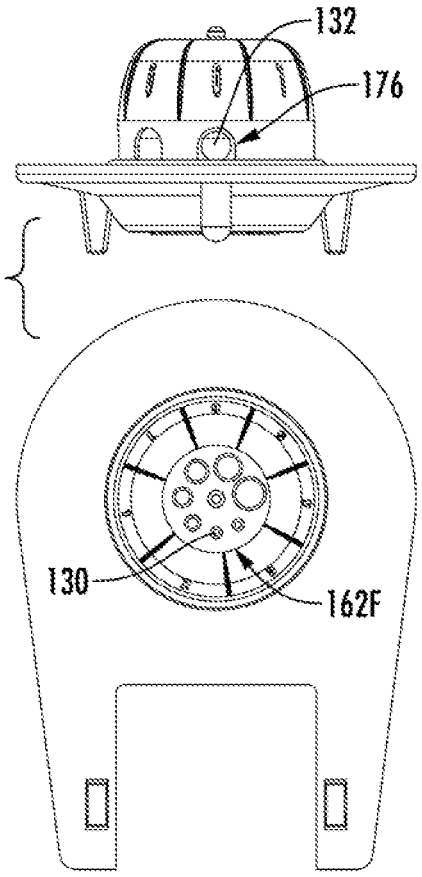
Figure 14:
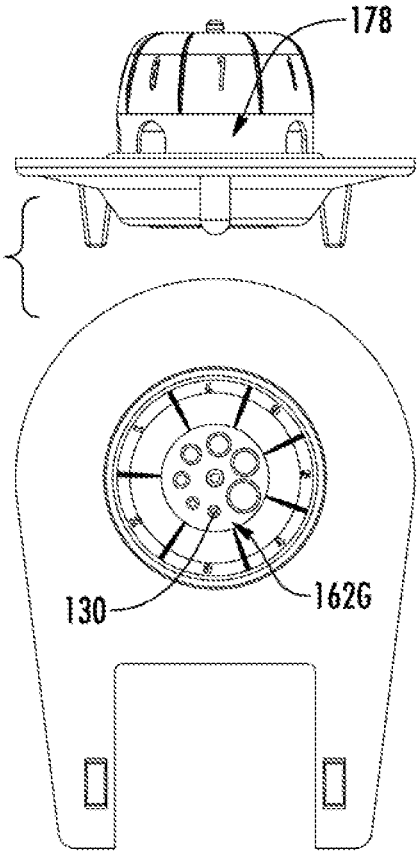

FIGS. 8-14 illustrate various levels of buoyancy with FIG. 8 being the least amount of buoyancy and FIG. 14 having the most amount of buoyancy.

The orientation in FIG. 8 has the largest aperture 162A of the first flow adjustment region 160 aligned with first port 130 and one of apertures 176 of the second flow adjustment region 170 aligned with second port 132. As such, it is the easiest for water to flow into port 130 as well as the easiest for air to flow out of port 132. As such, this is the least buoyant configuration.

The orientation of FIG. 13 has one of the smallest apertures, namely aperture 162F aligned with first port 130 while having one of apertures 176 aligned with second port 132. In this orientation, it is much more difficult for water to flow into the cone cavity of cone 120 but still easy for air to exit cone 120. As such, the buoyancy of this orientation is much greater than that of the orientation of FIG. 8.

FIGS. 9-12 are at varying ranges of buoyancy between that of FIG. 8 and FIG. 13 with increasing buoyancy from FIG. 9 to FIG. 12. This is due to the increasing diameter of the aperture 162 aligned with first port 130 when transitioning from one orientation to the next.

The orientation in FIG. 14 differs from the orientation in FIG. 13 in that rather than having an aperture 176 of the second flow adjustment region 170 aligned with second port 132, second port 132 is aligned with imperforate region 178. As such, the smallest aperture 162G is aligned with port 130 and the imperforate region 178 is aligned with second port 132. Thus, the least amount of flow of water into the cone 120 is permitted while the least amount of flow of air out of the cone 120 is permitted. Thus, this orientation has the greatest amount of buoyancy of the various orientations represented in FIGS. 8-14.

As illustrated with the various orientations of FIGS. 8-14, the user can adjust the buoyancy by changing the angular position of the adjustment dial relative to the cone 120. In some adjustments, only the size of the flow path through port is adjusted (see e.g. transitions between FIGS. 8-13.

In other adjustments, the change transitions from having port 132 uncovered to having second port 132 covered while the diameter of the aperture 162 covering first port 130 remains the same such that the same amount of the first port 130 is exposed in either orientation, e.g. transitioning from FIG. 13 to FIG. 14. These are just representative examples. In other situations, both the size of the aperture 162 and covering/uncovering port 132 can occur when transitioning from one orientation to the next.

Further, while a plurality of apertures 162 are used (e.g. one for each orientation in FIGS. 8-14), the ports could be replaced by a curved slot that varies in radial dimension when moving angularly about the axis of rotation 134.

Returning to FIG. 4, the adjustment dial includes an end region 184 that is positioned on a second side of the flange portion 150 opposite side 148. This captures the flange portion 150 of flapper 102 between flange 136 and end region 184 in a sandwiched arrangement. The flange 136 and end region 184 need not pinch the flange portion 150, but can be closely positioned to prevent flange portion 150 from pulling out between the portions of cone 120 and adjustment dial 122.

The snap engagement and securement of adjustment dial 122 to the cone 120 maintains the end region 184 of adjustment dial 122 axially adjacent flange portion 150 and flange 136.

The bottom side of the flapper 102 includes an annular channel 189 that receives the free end of the end region 184.

With continued reference to FIG. 4, hinge axis 112 is generally perpendicular to axis of rotation 134 (e.g. plus or minus 15 degrees and at a minimum to allow for manufacturing tolerances).

It is noted that first port 130 is offset from the second port 132 relative to hinge axis 112 along offset axis 190. In this embodiment, the first portion 130 is positioned closer to the hinge axis 112 than second portion 132. As such, the first port 130 is positioned between the hinge axis 112 and the second port 132 along offset axis 190. Offset axis 190 is generally perpendicular to axis of rotation 134 and hinge axis 112 (e.g. plus or minus 15 degrees).

Further, the first port 130 is positioned axially further from the seal region 104 and flapper 102 than second port 132 along the axis of rotation 134. As such, the second port 132 is positioned between the first port and the body of the flapper 102 along axis of rotation 134.

However, other configurations with different relative positions of the first and second ports are contemplated.

With reference to FIG. 3, in the illustrated embodiment, an indexing arrangement between the adjustment dial 122 and cone 120 is provided. The indexing arrangement includes a plurality of recesses 192 that cooperate with a radially extending nib 194. The nib and recesses could be formed in the opposite one of the adjustment dial 122 and cone 120 in alternative arrangements.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A toilet flapper valve assembly comprising:

a flapper;

a cone mounted to the flapper, the cone and flapper defining a cavity, the cone having a first port and a second port, the first and second ports fluidly communicating the cavity with an exterior of the cone;

an adjustment dial rotatably mounted relative to the flapper for rotation about an axis of rotation, the adjustment dial having a first flow adjustment region that cooperates with the first port for regulating flow therethrough and a second flow adjustment region that cooperates with the second port for regulating flow therethrough, the first and second flow adjustment regions fixed to one another such that rotation of the adjustment dial about the axis of rotation simultaneously rotates both the first and second flow adjustment regions about the axis of rotation relative to the first and second ports;

the first flow adjustment region including a first flow region that extends angularly about the axis of rotation, the first flow region having a first portion that increases in dimension when moving angularly in a first direction about the axis of rotation to vary a degree of exposure of the first port to fluid communication with the exterior of the cone; and the second flow adjustment region includes at least one second flow adjustment region flow aperture and at least one imperforate region adjacent the at least one second flow adjustment region flow aperture.

2. The toilet flapper valve assembly of claim 1, wherein:

in a first angular position of the adjustment dial relative to the cone, a first section of the first flow region aligns with the first port while the at least one second flow adjustment region flow aperture aligns with the second port; and in a second angular position of the adjustment dial relative to the cone, a second section of the first flow region aligns with the first port while the imperforate region aligns with and covers the second port.

3. The toilet flapper valve assembly of claim 2, wherein the first and second sections of the first flow region have a same size and expose a same amount of the first port to fluid communication with the exterior of the cone.

4. The toilet flapper valve assembly of claim 2, wherein:

the first flow region is formed by a plurality of spaced apart first flow adjustment region apertures extending through the adjustment dial and angularly about the axis of rotation;

the first portion of the first flow region that increases in dimension when moving angularly in the first direction about the axis of rotation being provided by diameters of the plurality of spaced apart first flow adjustment region apertures increasing in diameter when moving angularly in the first direction about the axis of rotation.

5. The toilet flapper valve assembly of claim 4, wherein:

the plurality of spaced apart first flow adjustment region apertures includes at least a first aperture and a second aperture that have a same diameter, the first aperture being part of the first section of the first flow region; and the second aperture being part of the second section of the first flow region.

6. The toilet flapper valve assembly of claim 2, wherein:

the first flow region is formed by a plurality of spaced apart first flow adjustment region apertures extending through the adjustment dial and angularly about the axis of rotation;

the plurality of spaced apart first flow adjustment region apertures includes at least a first aperture and a second aperture that have a same diameter;

the first aperture being part of the first section of the first flow region; and the second aperture being part of the second section of the first flow region.

7. The toilet flapper valve assembly of claim 1, wherein the adjustment dial is snap attached to the cone.

8. The toilet flapper valve assembly of claim 1, wherein:

the cone includes a radially extending annular flange;

the flapper includes an opening bounded by a flange portion, the cone extending axially through the opening with the annular flange of the cone positioned on a first side of the flange portion of the flapper; and the adjustment dial includes an end region that is positioned on a second side of the flange portion of the flapper capturing the flange portion of the flapper axially therebetween in a sandwiched arrangement axially securing the cone and adjustment dial to the flapper.

9. The toilet flapper valve assembly of claim 8, wherein the adjustment dial is snap attached to the cone axially securing the adjustment dial to the cone.

10. The toilet flapper valve assembly of claim 9, wherein:

the radially extending flange of the cone is proximate the second port;

the snap attachment between the adjustment dial and the cone is proximate the first port.

11. The toilet flapper valve assembly of claim 9, wherein the snap attachment between the cone and the adjustment dial maintains the end region of the adjustment dial in axial location relative to the annular flange of the cone and the flange portion of the flapper.

12. The toilet flapper valve assembly of claim 1, further comprising a hinge component attached to the flapper defining a hinge axis that is generally perpendicular to the axis of rotation;

the first port is axially offset from the hinge axis a first distance along an offset axis that is generally perpendicular to the hinge axis and the axis of rotation; and the second port is axially offset from the hinge axis a second distance along the offset axis.

13. The toilet flapper valve assembly of claim 12, wherein the cone extends outward from the flapper to a free end of the cone, the first port being positioned proximate the free end and the second port being positioned proximate the flapper.

14. The toilet flapper valve assembly of claim 12, wherein the second distance is greater than the first distance.

15. The toilet flapper valve assembly of claim 4, wherein:

the plurality of spaced apart first flow adjustment region apertures that form the first flow region are formed in a distal end of the adjustment dial;

the at least one second flow adjustment region flow aperture of the second flow adjustment region is formed in an annular side of the adjustment dial;

flow through the plurality of spaced apart first flow adjustment region apertures that form the first flow region is substantially perpendicular to the flow through the at least one second flow adjustment region flow aperture of the second flow adjustment region.

16. The toilet flapper valve of claim 5, wherein the plurality of spaced apart first flow adjustment region apertures forming the first flow region include a third aperture angularly spaced from the first and second apertures, the third aperture having a diameter that is greater than the diameter of the first and second apertures.

17. The toilet flapper valve assembly of claim 1, wherein the cone is mounted to the flapper in a fixed angular position relative to the axis of rotation such that the first and second ports remain in a fixed orientation relative to the flapper regardless of a position of the adjustment dial.

18. A method of adjusting the buoyancy of a toilet flapper valve assembly of claim 1 comprising:

rotating the adjustment dial about the axis of rotation relative to the cone to simultaneously adjust which portion of the first flow adjustment region aligns with the first port and which portion of the second flow adjustment region aligns with the second port.

* * * * *